United States Patent [19]

Boeckmann

[11] Patent Number: 5,031,848

[45] Date of Patent: Jul. 16, 1991

[54] GUIDING SPIRALLY WOUND ZIPPERED FILM TO A CONSTANT INFEED POINT

[75] Inventor: Hugo Boeckmann, Arlington Heights, Ill.

[73] Assignee: Zip-Pak Incorporated, Northbrook, Ill.

[21] Appl. No.: 468,065

[22] Filed: Jan. 22, 1990

[51] Int. Cl.[5] ..... B65H 16/00

[52] U.S. Cl. ..... 242/55; 242/76; 226/196

[58] Field of Search ..... 242/55, 57.1, 76, 158 R, 242/157.1; 226/196, 18, 19, 197, 198, 199

[56] References Cited

U.S. PATENT DOCUMENTS

| | | | |
|---|---|---|---|
| 2,325,738 | 8/1943 | Brangle et al. | 226/196 X |
| 2,989,265 | 6/1961 | Selsted | 242/76 |
| 2,996,951 | 8/1961 | Debrie | 242/76 X |
| 3,131,843 | 5/1964 | Bentley | 226/196 X |
| 3,135,198 | 6/1964 | Kingsley | 226/196 X |
| 3,253,798 | 5/1966 | Wangerin et al. | 242/76 |
| 3,934,775 | 1/1976 | Keller | 226/196 |
| 4,212,422 | 7/1980 | Rauchfuss et al. | 242/57.1 X |
| 4,324,488 | 4/1982 | Anderson et al. | 226/18 |
| 4,586,670 | 5/1986 | Vancelette et al. | 242/55 |
| 4,600,161 | 7/1986 | Barboza | 242/55 |

*Primary Examiner*—John M. Jillions

*Attorney, Agent, or Firm*—Hill, Van Santen, Steadman & Simpson

[57] ABSTRACT

Zippered film which is spirally wound on a non-oscillating rotary spool is guided to a constant point of infeed by running the zippered film from the spool to such infeed point through an oscillating guide device.

20 Claims, 1 Drawing Sheet

FIG. 2
FIG. 1
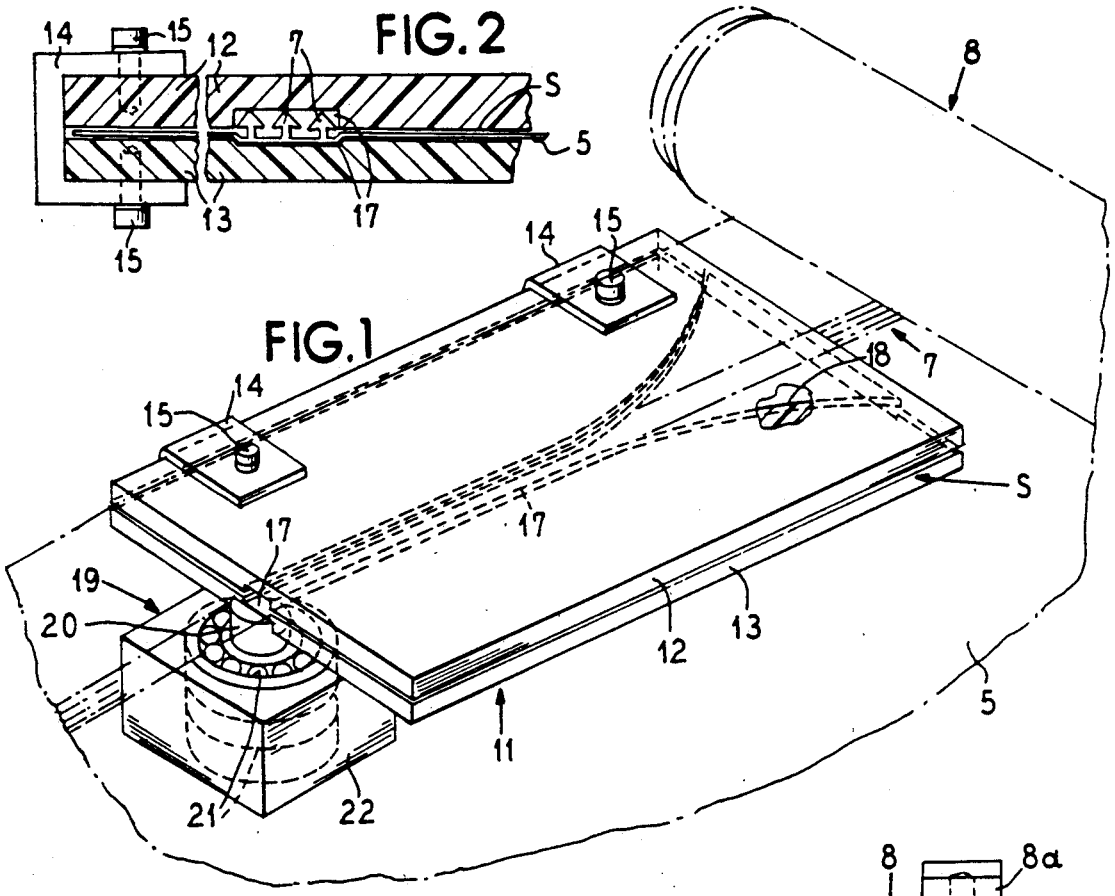
FIG. 3
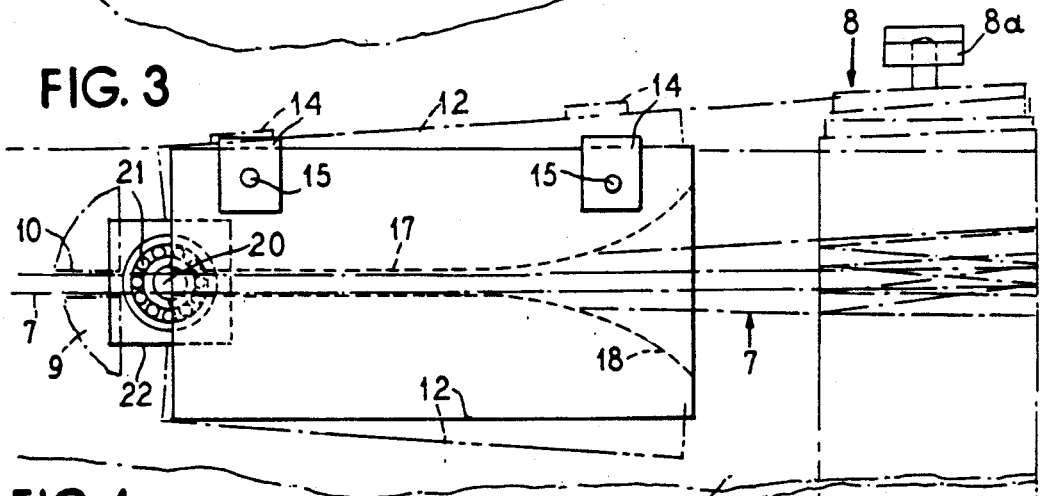
FIG. 4
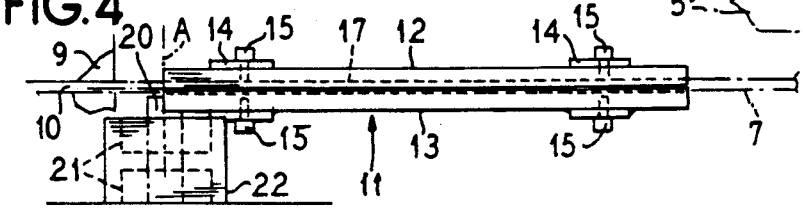

GUIDING SPIRALLY WOUND ZIPPERED FILM TO A CONSTANT INFEED POINT

BACKGROUND OF THE INVENTION

The present invention relates to handling of longitudinally zippered film, such as may be used for making bags or packages, but not limited to such use, from a spirally wound spool to a constant point of infeed.

Commonly endless supply of longitudinally zipper film is spirally wound on a supply spool in order to avoid as nearly as practicable overlapping build up of the substantially greater mass zipper. On the other hand, at the point of use, it is necessary to deliver the film with the zipper at a constant point of infeed. Heretofore this problem has generally been met by mounting the supply spool on an oscillating stand controlled to effect the desired infeed. However, such oscillating stands require elaborate operating and tracking mechanism.

SUMMARY OF THE PRESENT INVENTION

An important object of the present invention is to eliminate the need for oscillating stands where spirally wound zippered film is directed to a constant point of infeed.

Another object of the invention is to provide new and improved method of and means for guiding spirally wound longitudinally zippered film from a non-oscillating supply spool to a constant infeed point.

Still another object of the invention is to provide a new and improved simple, economical and efficient method of and means for tracking spirally wound zippered film from a non-oscillating supply spool to a constant point of infeed.

Pursuant to the present invention, there is provided a new and improved device for guiding longitudinally zippered film from a spool on which the film is spirally wound, to a constant zipper infeed point, comprising an oscillating film guide member having a zipper guide track with an entrance at one end of the member for receiving the zipper on the film and an exit at the opposite end of the member, and means for mounting the guide member on an oscillating axis extending in substantially transverse alignment with the exit for maintaining said exit constantly aligned with the infeed point in all oscillational positions of the member.

There is also provided a new and improved method of tracking spirally wound zippered film to a constant point of infeed.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

FIG. 1 is a more or less schematic perspective view showing a device embodying the present invention;

FIG. 2 is an enlarged fragmental sectional elevational view taken substantially along the line II—II in FIG. 1;

FIG. 3 is a top plan view of the device of FIG. 1; and

FIG. 4 is a side elevational view of the device.

DETAILED DESCRIPTION

Film 5 of any preferred form, plastic, or otherwise, provided with longitudinally extending zipper 7, such as extruded plastic profiled zipper is unwound from a rotary axially non-oscillating spool 8, mounted on a stand 8*a*, and fed to a constant point of infeed 9 having a zipper track 10 (FIG. 4). Inasmuch as the zippered film is, in customary fashion, spirally wound on the spool 8, it is necessary to provide some means for guiding the same to the infeed point 9 in a non-deviating, substantially straight-in manner in order to avoid twisting or wrinkling of the film at the point of use apparatus.

According to the present invention, a new and improved guide means device 11 is provided which will in a simple, direct manner guide the spirally wound zippered film 5 from the spool 8 to the constant point of infeed at 9, 10. In a simple, efficient, economical form, the guide device 11 comprises a pair of complementary panels 12 and 13 which are secured in substantially coextensive suitably spaced parallel relation by means of U-shaped brackets 14 within which the side edges of the panels 12 and 13 are engaged along the side of the film 8 nearest to the zipper 7. Although any suitable means for securing the panels 12 and 13 to the brackets 14 may be employed, one preferred means comprises screws 15. In a lightweight, minimum friction or friction-free structure, the panels 12 and 13 may be constructed of a self-sustaining or rigid plastic material, such as nylon or polytetrafluoroethelene, although polytetraflourethelene coated aluminum or thin steel panels may be used if preferred.

A gap space S between the panels 12 and 13 should be just enough to permit the film 8 to travel through the gap freely as drawn therethrough from the spool 8 by traction means (not shown) associated with the point of use. As the film 8 travels into and through the gap S of the guide device 11, the zipper is slidably engaged in a longitudinal guide groove track 17 which has a flared entrance 18 to receive the zipper 7 smoothly thereinto. Although the track 17 may be predominantly in the panel 12, it may alternatively be in the panel 13. As a practical matter, the track 17 is shown as partially in both the panels 12 and 13 to accommodate the substantially greater cross sectional bulk of the zipper 7 than the thickness of the film 5. The gap S between the panels 12 and 13 is open along the side of the panel assembly opposite the brackets 14 so that the film may project freely laterally from the guide device 11.

To maintain proper guiding orientation of the guide device 11 relative to the spool 8 and the infeed point 9, mounting means 19 are provided comprising an axle in the form of a pin or post 20 secured fixedly to the guide plate assembly panel 13 at the exit end of the track 17, with an antifriction swivel mount for the post 20 comprising a roller bearing assembly 21 in a fixed supporting block 22.

Constant alignment of the guide track exit with the infeed point is maintained by having the oscillating axis A of the post 20 extend in substantially transverse alignment with the track exit. This maintains the exit constantly aligned with the infeed point in all oscillational positions of the device 11.

The swinging or oscillation range of the device 11 is exemplified in FIG. 3 by the opposite dot/dash positions, although this is merely by way of example and it will be apparent that the oscillation range may be greater or less. At all times the exit from the track 17 will remain in proper alignment with the entrance to the infeed track 10.

It will be understood that variations and modifications may be effected without departing from the spirit and scope of the novel concepts of the present invention.

What is claimed is:

1. A device for guiding longitudinally zippered film from a spool on which the film is spirally wound, to a constant zipper infeed point, comprising:

an oscillating film guide member having a zipper guide track with an entrance at one end of the member for receiving the zipper on the film and an exit at the opposite end of the member; and means for mounting said guide member on an oscillating axis extending in substantially transverse alignment with said exit for maintaining said exit constantly aligned with said infeed point in all oscillational positions of said member.

2. A device according to claim 1, wherein said film guide member comprises a pair of closely spaced panels, and means for maintaining the panels in the spaced relation.

3. A device according to claim 2, wherein at least one of said panels has said zipper track, and said entrance comprising a flared infeed guide structure.

4. A device according to claim 1, wherein said mounting means comprises an oscillatable post member in an anti-friction mount.

5. A device according to claim 1, in combination with said spool, and a fixed stand supporting said spool so that as the spirally wound film unwinds, said member is caused to oscillate in accordance with the spiral travel path of the zipper with the film moving through said guide member.

6. A combination according to claim 5, wherein said guide member has a film guide gap therethrough which is open along at least one side of the member for freedom of projection of the film laterally from the member.

7. A device for guiding a longitudinally zippered film from a non-oscillating spool on which the film is spirally wound, to a constant point of zipper infeed, comprising:

a zipper track for guiding the zipper from the spool to said infeed point with said track having an entrance and an exit with said exit aligned with said point;

a swivel mount at said exit accommodating swiveling of the track for maintaining the exit from said track aligned with said infeed point and permitting free movement of the entrance.

8. A device according to claim 7, wherein said film guide member comprises a pair of closely spaced panels, and means for maintaining the panels in the spaced relation.

9. A device according to claim 8, wherein at least one of said panels has said zipper track and said entrance comprising a flared infeed guide structure.

10. A device according to claim 7, wherein said comprises an oscillatable post member in an anti-friction mount.

11. A method of guiding longitudinally zippered film from a rotary spool on which the film is spirally wound, to a constant zipper infeed point, comprising:

guiding the film through an oscillating film guide member having a zipper guide track with an entrance at one end of the member for receiving the zipper on the film and a zipper feed guide exit at the opposite end of the member; and mounting said guide member on an oscillation axis extending in substantially transverse alignment with said exit and thereby maintaining said exit constantly aligned with said infeed point in all oscillational positions of said member.

12. A method according to claim 11, comprising providing said film guide member with a pair of closely spaced panels, and maintaining the panels in the spaced relation.

13. A method according to claim 12, comprising providing at least one of said panels with said zipper track and providing said entrance with a flared infeed guide structure.

14. A method according to claim 11, comprising mounting an oscillatable post member providing said axis in an anti-friction mount.

15. A method according to claim 11, comprising mounting said spool on a fixed supporting stand and as the spirally wound film unwinds causing said member to oscillate in accordance with the spiral travel path of the zipper with the film moving through said guide member.

16. A method according to claim 15, comprising providing said guide member with a film guide gap therethrough which is open along at least one side of the member for freedom of projection of the film laterally from the member.

17. A method of guiding a longitudinally zippered film from a non-oscillating rotary spool on which the film is spirally wound, to a constant point of zipper infeed, comprising:

providing a zipper track device with an entrance and an exit for guiding the zipper from the spool to said infeed point; and controlling said track device by supporting the track on a swivel at the exit for maintaining the exit from said track device aligned with said infeed point and permitting free movement of the entrance.

18. A method according to claim 17, comprising providing said zipper track device in the form of a guide member having a pair of closely spaced panels, and maintaining the panels in the spaced relation.

19. A method according to claim 18, comprising providing said zipper track device with track groove means in at least one of said panels, and providing said exit at one end of said groove means and said entrance at the other end of said groove means.

20. A method according to claim 17, comprising mounting said device on an anti-friction axle aligned with said exit.

* * * * *